US009622562B2

(12) United States Patent
Hering

(10) Patent No.: US 9,622,562 B2
(45) Date of Patent: Apr. 18, 2017

(54) MUSICAL COMB

(71) Applicant: Dean H. Hering, Raleigh, NC (US)

(72) Inventor: Dean H. Hering, Raleigh, NC (US)

( * ) Notice: Subject to any disclaimer, the term of this patent is extended or adjusted under 35 U.S.C. 154(b) by 0 days.

(21) Appl. No.: 14/737,976

(22) Filed: Jun. 12, 2015

(65) Prior Publication Data

US 2016/0360852 A1 Dec. 15, 2016

(51) Int. Cl.
*A45D 24/02* (2006.01)
*G10D 17/00* (2006.01)

(52) U.S. Cl.
CPC ..... *A45D 24/02* (2013.01); *G10D 17/00* (2013.01)

(58) Field of Classification Search
CPC ..... A46B 15/0042; A46B 15/004; A46B 15/0028; A45D 24/04
USPC ..... 132/161
See application file for complete search history.

(56) References Cited

U.S. PATENT DOCUMENTS 2,442,447 A 6/1948 Zadig
2,493,119 A * 1/1950 Duncan ..... G10F 1/06 132/155
2,504,666 A * 4/1950 Duncan ..... G10F 1/06 132/161
3,319,507 A 5/1967 Wolcott
7,973,229 B2 7/2011 Chuang
2003/0015210 A1* 1/2003 Alexander ..... A45D 2/002 132/116

FOREIGN PATENT DOCUMENTS

CN 2082553 U 8/1991
CN 2206056 Y 8/1995
CN 2561257 Y 7/2003
CN 1476798 A 2/2004

OTHER PUBLICATIONS http://bestclassicaltunes.com/dictionarypiano.aspx.*
"Musical hair combs," maartenidema.com. Jan. 20, 2008 (1 page).
"MODhair: Musical comb businesscard," adsoftheworld.com, Apr. 2010 (6 pages).
Baird-Remba et al., "23 Badass Inventions Made by Ordinary Chinese People," Business Insider, Mar. 27, 2013 (25 pages).

* cited by examiner

*Primary Examiner* — Todd E Manahan
*Assistant Examiner* — Brianne Kalach
(74) *Attorney, Agent, or Firm* — NSIP Law

(57) ABSTRACT

A personal grooming device a body defining a grasping surface defining an outer portion and an inner portion, as well as groups of members extending directly from the inner portion at varying depth so that the members are capable of playing a musical note or notes.

15 Claims, 5 Drawing Sheets

| Note Number | Note Name | Beats | Frequency (Hz) |
|---|---|---|---|
| 1 | G4 | 1 | 391.995 |
| 2 | C5 | 1.5 | 523.251 |
| 3 | C5 | 1 | 523.251 |
| 4 | C5 | 2 | 523.251 |
| 5 | G4 | 1 | 391.995 |
| 6 | D5 | 1.5 | 587.330 |
| 7 | B4 | 1 | 493.883 |
| 8 | C5 | 2 | 523.251 |

FIG. 4B

MUSICAL COMB

BACKGROUND

1. Field

The following description relates to personal grooming devices intended to achieve dual functions, namely those of personal grooming as well as relay of information such as music.

2. Description of Related Art

When providing such a grooming device, like that of a hair comb, it is desirable and necessary to preserve aspects that define the identity of the device as a comb and facilitate the combing function. For instance, some of these aspects may include teeth having ends that are collinear, so as to be aligned along a same row, and wherein the teeth are substantially evenly spaced relative to each other and connected to a handle. Each of these aspects enables grasping of hair at a desired depth so as to permit the comb to sweep evenly through hair without becoming stuck, as may occur with clumped hair sometimes occasioned by excess water in the hair or uneven drying thereof.

Thus far, past designs attempting the aforementioned dual functions of personal grooming and music relay have varied. Such variation has particularly included separate attachment of the teeth to the handle so as to allow for possible displacement of one or more teeth while combing or attempting to play music, as well as teeth that must calibrated to a certain depth within the comb, resulting in extreme height differences between neighboring teeth which inevitably disallow even passage through hair at a certain depth. Yet further variation has included a sharply inclined base yielding teeth that are substantially smaller in size at one end of the comb than at another end whereby the similar drawback of uneven combing exists.

Accordingly, it is desirable to provide a personal grooming device such as a comb capable of preserving the identity and functionality thereof, while also enabling the effective playing of music.

SUMMARY

In one general aspect, there is provided a personal grooming device, the device including a body comprising a grasping surface defining an outer portion and an inner portion thereof, and groups of members extending directly from the inner portion at varying depth, and configured to each play a musical note.

An aspect thereof may include a respective group of members that is configured to play a musical note, wherein the musical note is selected from the group consisting of a same musical note and a different musical note with respect to an adjacent, respective group of members.

Another aspect thereof may include respective groups of members that are separated by a gap therebetween such that a member does not extend from the inner portion at the gap.

Another aspect thereof may include a distance that respective groups of members extend from the inner portion being defined as a same distance or a different distance.

Another aspect thereof may include the distance being a different distance.

In another general aspect, there is provided a personal grooming device, the device including a body, and groupings of members extending from the body and being separated by a gap therebetween in which a length of the gap corresponds to spacing between musical notes which the groupings of members are configured to play, respectively.

An aspect thereof may include a number of the members within a respective group corresponding to a duration that a note is to be played.

An aspect of the another general aspect may include lengths of members of the groupings corresponding to frequencies of the musical notes.

An aspect thereof may include lengths of members of a respective grouping being the same.

An aspect thereof may include lengths of successively adjacent groupings of members being based on a frequency corresponding to a length of members of a preceding group thereof.

An aspect of the another general aspect in which lengths of members of the groupings correspond to frequencies of the musical notes may include variation in the lengths of the members from the body corresponding to a variation of depth of a body surface from which the members extend.

Another aspect thereof may include the body surface being an inner surface opposite an outer surface of the body which is configured to be grasped by a user.

Another aspect thereof may include terminal portions of the members being collinear.

Another aspect thereof may include the body being expansible.

An aspect of the another general aspect may include the body being expansible.

In yet another general aspect, there is provided a musical comb, the musical comb including a base including a peak and a valley, and teeth of equal height positioned throughout the valley of the base, wherein some of the teeth are equally spaced apart and at least one tooth of the teeth is unequally spaced apart from the other teeth.

An aspect thereof may include teeth of equal height positioned throughout a peak of the base, wherein some of the teeth are equally spaced apart and at least one tooth of the teeth is unequally spaced apart from the other teeth.

An aspect thereof may include the teeth positioned throughout the valley and the peak being respectively unequally spaced from each other by a gap therebetween.

An aspect thereof may include the teeth positioned throughout the valley and the peak being adjacent, and separated by a gap therebetween.

Other features and aspects may be apparent from the following detailed description, the drawings and the claims.

BRIEF DESCRIPTION OF THE DRAWINGS

FIG. 4B is an example chart diagram corresponding to FIG. 4A.

Figure 1:
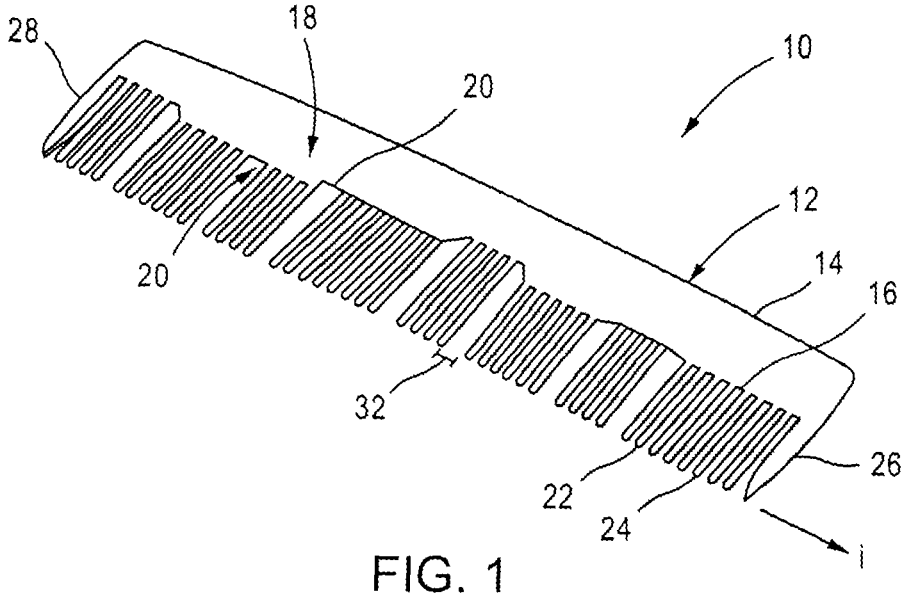
FIG. 1 is a front and side elevational view illustrating an example of a personal grooming device accomplishing dual functions, and namely personal grooming as well as relay of information such as music.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein may be suggested to those of ordinary skill in the art. Also, descriptions of well-known functions and constructions may be omitted for increased clarity and conciseness.

FIG. 1 illustrates an example of a personal grooming device 10 accomplishing dual functions, and namely personal grooming as well as relay of information such as music.

As shown therein, the device 10 is optionally formed as a comb and includes a body 12 defining an outer portion 14 and an inner portion 16 providing a grasping surface 18 therebetween which a user may grasp, as a handle, when using the device 10 to either comb hair or play music. The inner portion 16 provides a base 20 from which members such as comb teeth 22 directly extend. As is also shown, the teeth 22 are aligned at their terminal portions 24 distal to their direct connection to the base 20 so as to be collinear. That is, the terminal portions 24 extend along a row, and more particularly, touch an imaginary line "i" connecting opposing ends 26, 28 of outer portion 14.

As will be appreciated from the illustrated arrangement of teeth 22 shown in FIGS. 1 and 2, such teeth 22 are arranged in groups A-H, whereby the groups A-H of teeth 22 each enable playing of a musical note upon movement of the teeth 22 of a particular group, as discussed hereinafter. Each of the teeth 22 belonging to groups A-H are, as shown, equally spaced from each other and contemplated to be of a height or length "l" corresponding to a relative frequency of a note to be played upon movement of teeth 22 within a particular group of teeth 22. Separating each of the shown groups A-H of teeth 22 are gaps 30 which enable a user of the device 10 to play a particular note in isolation by plucking only a particular group A-H of teeth 22. The gaps 30 also permit a user time to hear, and thus perceive, separation between notes of music which describe a particular tune or song. In other words, the gaps 30 enable a user to have pause and transition period from one note to a successive note to be played. Accordingly, it will be understood that the spaced length 32 of the gap 30 is a function of the spacing between the musical notes to be played and may be determined arbitrarily in accordance with the length of device 10.

As shown with reference to FIGS. 2, 4A and 4B, the length "l" of teeth 22 of each of the groups of teeth 22 determines the relative frequency for a given musical note, as discussed below. Thus, in order to preserve the combing function and identity of the device 10 as a comb whereby the terminal portions 24 of teeth 22 are collinear, the base 20 from which the teeth extend is provided with a variable contour 34. This contour 34 provides, optionally, a variable depth of the grasping surface 18 so as to define peaks 36 and valleys 38 of the base 20 relative to the terminal portions 24 of the teeth 22. Thus, lengths "l" of teeth 22 of a given group of teeth 22 may be optionally sized so as to be distanced from the contour 34 according to their required, relative frequency by tailoring the contour 34 of the base 20 to accommodate the aforementioned collinearity.

Figure 2:
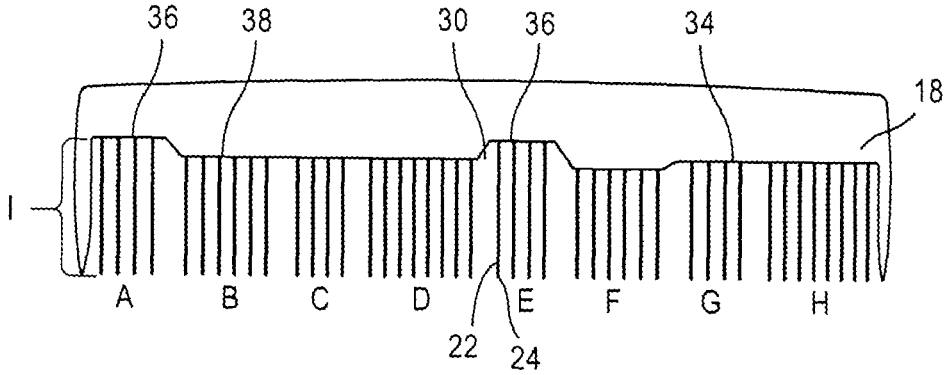
FIG. 2 is a front perspective view of the personal grooming device of FIG. 1.
Figure 3:
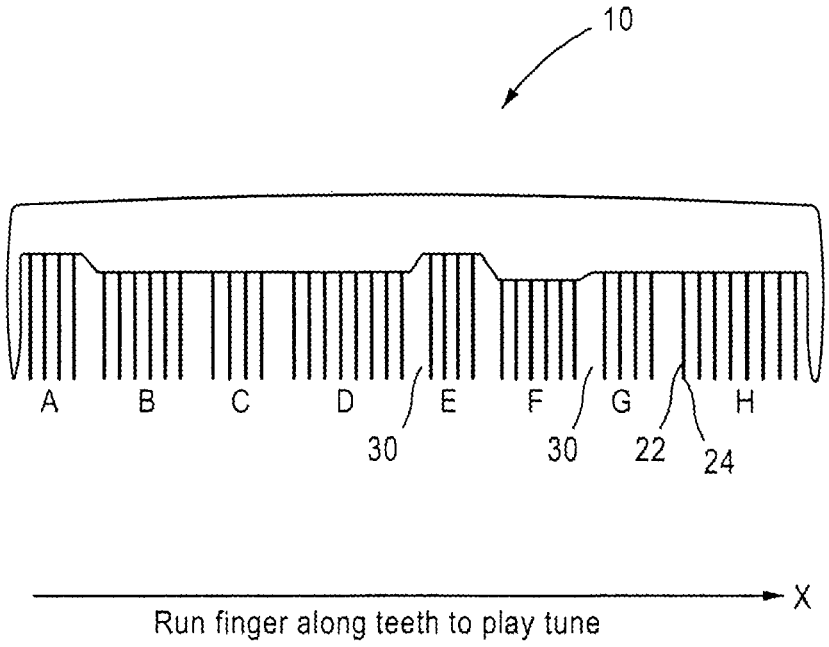
FIG. 3 is a front perspective view of the personal grooming device of FIG. 1 illustrating a manner of playing music.

With further reference to FIG. 2, each group A-H of teeth 22 is shown to include several teeth 22, though it is contemplated that a group of teeth may, as an example, have a single tooth 22. As such, when playing the device 10 to relay a desired tune or song, the tooth 22, a group of teeth 22 or all of the groups A-H of teeth 22 may be played by plucking the teeth 22. As an example, a user of the device 10 may simply play the musical notes of the groups A-H by moving his or her finger along the terminal portions 24 of the teeth 22 in the direction of arrow X, as shown in FIG. 3. When doing so, it is contemplated that the user will appreciate a familiarity of a played note corresponding to a group of teeth 22 due to the gaps 30 between groups A-H of teeth 22. The duration of a given note corresponding to a particular group of teeth 22 corresponds to the number of teeth 22 within a grouping thereof so as to define the duration in musical beats, as discussed below.

Frequency and Duration

To recognize a tune, the human ear does not need to hear the exact frequency and duration of notes. Rather, perception of the relative frequencies and durations of notes of a tune or song is the essential component for recognizing a familiarity of a reproduction of the tune or song. Maintenance of these relative frequencies and durations enable the music to be scaled to different "keys."

Referring again to FIG. 2, frequency of a particular note is, as discussed, determined by a length "l" of teeth 22 for a particular group thereof. As also discussed, relative frequencies between notes must be maintained, such that for a first note, a ratio of a known, corresponding frequency, $f_n$, and thus a known, predetermined length, $L_n$, to a successive frequency, $f_{n+1}$, must be maintained; whereby a length "l" of teeth 22 for the corresponding, successively adjacent group of teeth 22 necessary to play its corresponding note may be calculated in accordance with Equation (1) below, assuming a tooth 22 of the device 10 represents a cantilevered beam and $f_1$ and $f_2$ represent examples of successively adjacent frequencies.

$$f_1/f_2 = (\omega_1/2\pi)/(\omega_2/2\pi) = \omega_1/\omega_2 = \frac{\sqrt{EI/m_1L_1^4}}{\sqrt{EI/m_2L_2^4}}, \quad \text{Equation (1)}$$

where frequency (f) measured in (Hz) is related to circular frequency by $f=\omega/2\pi$ (where $\omega$ is the circular natural frequency given by $1.875^2\ (EI/mL^4)^{1/2}$, E is the modulus of rigidity of the tooth material, m is the mass of the tooth, I is the moment of inertia of the tooth cross-section, and L is the length of the tooth. As will be understood, the differences in masses relative to the lengths to the fourth power may be considered to be negligible such that the masses may be considered to be the same.

Thus, with the above ratio of relative frequencies, the equation to obtain successive lengths of teeth 22 for groups of teeth 22 along the device 10 may be reduced to Equation (2), shown below.

$$L_2 = L_1\sqrt{f_2/f_1} \quad \text{Equation (2):}$$

With their relative lengths being determined in accordance with the above, a duration of each of the notes respectively assigned to the groups A-H of teeth 22 is determined, optionally, in accordance with a predetermined number of teeth 22 corresponding to a beat, which will be understood, is a measure of the aforementioned duration. For instance, if a given note is intended to last a duration of two (2) beats, and a beat is predetermined to be represented by four (4) teeth, the number of teeth 22 corresponding to the two (2) beat duration is eight (8) teeth.

Figure 5:
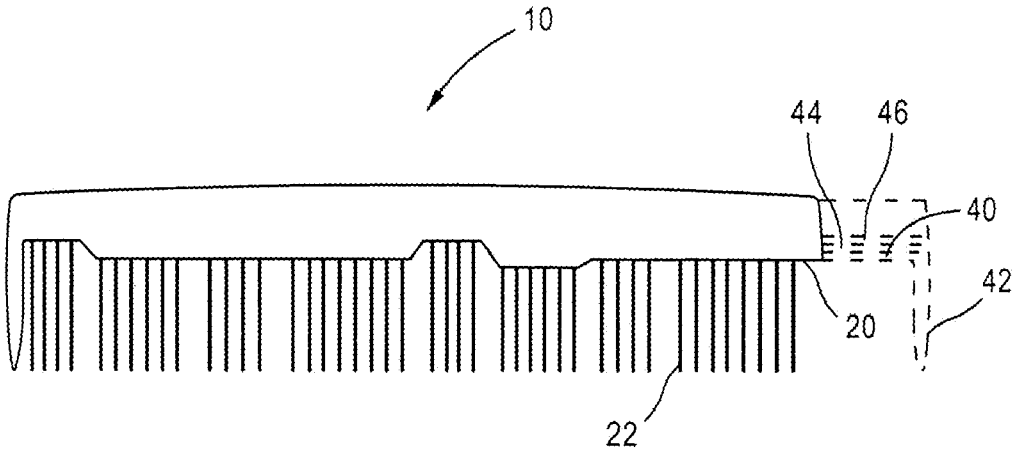
FIG. 5 is a front perspective view of the personal grooming device of FIG. 1 illustrating expansability thereof.

In view of the above, it is thus further contemplated that, as illustrated in FIG. 5, the device 10 may, optionally, be expansible whereby at least one of outer portion ends 26, 28 is removed to accommodate a further base portion 40 (having teeth 22 thereof omitted for clarity of illustration). As shown, base portion 40 includes a further outer end portion 42 and adjoins base portion 20 along overlapping guide rails 44, 46 fixedly connected therebetween in any known manner such as by soldering, screw-attachment or gluing. As such, whether the device 10 is expansible or not, it is further contemplated that a musical chord may optionally be played.

As an example, the device 10 as described hereinabove may be made in accordance with methods such as 3D printing and injection molding. As another example, the device 10 herein may made using any method producing the same in finished form from metal, plastic or any hybrid of metal and plastic.

Figure 4A:
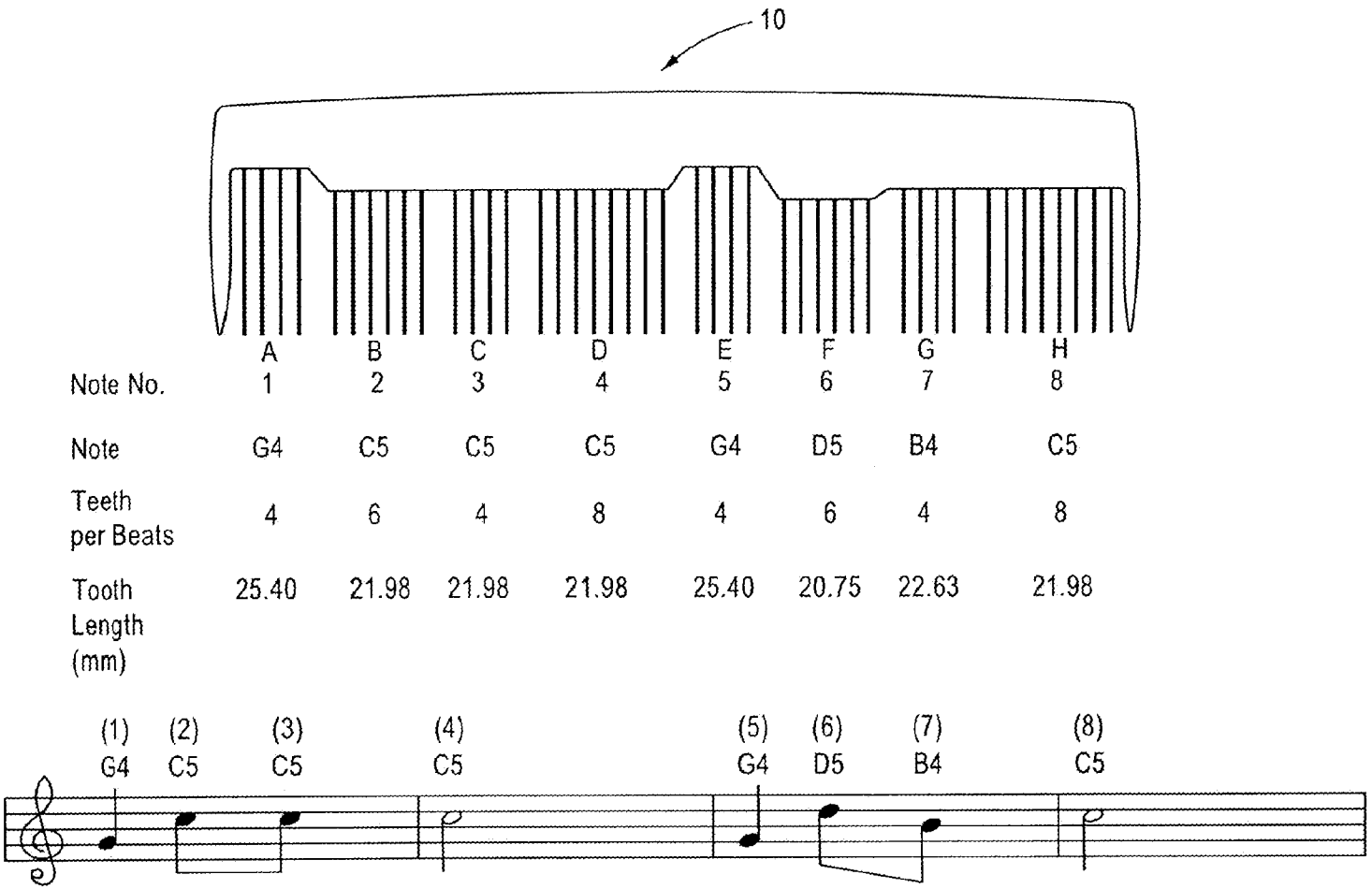
FIG. 4A is an example illustration of correspondence between the personal grooming device of FIG. 1 and a song to be played using the device.

A working example of the personal grooming device is illustrated in FIGS. 4A and 4B. Therein, a tune from the well-known wedding song, "Here Comes the Bride," is illustrated along with a representative selection of sheet music having the indicated, "Note No.," indicated parenthetically thereat. Correspondence between the device 10 and the tune is shown so as to relate assignment of particular notes to groups A-H of teeth 22, together with their respective frequencies as determined by the length of teeth 22 within those groups A-H. More specifically, with the quarter note, G4, as reference Note 1 having a standard frequency of 391.995 Hz and duration of 1 beat corresponding to four (4) teeth, and each group A-H of teeth 22 assigned a respective note number, successive lengths of teeth 22 for successively adjacent notes may be calculated in accordance with the frequency of the preceding note in the tune. Furthermore, since, as shown, four (4) teeth were predetermined to carry the duration of one (1) beat of Note 1, musical Note four (4), in contrast and corresponding to half note C5, with a duration of two (2) beats, is shown as being assigned eight (8) teeth.

A number of examples have been described above. Nevertheless, it will be understood that various modifications may be made. For example, suitable results may be achieved if the described techniques are performed by a different calculation and/or if components in a described device are combined in a different manner and/or replaced or supplemented by other components or their equivalents. Accordingly, other implementations are within the scope of the following claims.

What is claimed is:

1. A personal grooming device usable to comb hair or play notes of a musical composition, comprising:

a body having a grasping surface defining an outer portion and an inner portion of the body, the inner portion having a varied contour; and a plurality of spaced members each extending directly from the inner portion to a terminal portion, the terminal portions of all members being collinear and the length of each member being defined by the local contour of the inner portion from which it extends, wherein:

the members are arranged in successive groups, each group configured to play a single note of the musical composition, each of at least two of the groups has a plurality of equally spaced members of equal length that collectively play that group's respective note for a duration proportional to the number of members in that group by plucking all the members of that group consecutively in one continuous stroke, and the groups of members are separated by gaps wider than the spacing between the members of each group, the gaps yielding pauses between adjacent musical notes during play.

2. The personal grooming device of claim 1, wherein:

the members are in a straight-line arrangement.

3. The personal grooming device of claim 2, wherein:

the lengths of the members correspond to relative frequencies of the respective musical notes.

4. A personal grooming device usable to comb hair or play notes of a musical composition, comprising:

a body having a grasping portion; and a straight-line arrangement of spaced teeth extending from the body to respective terminal portions that are collinear, wherein:

the teeth are arranged in successive groups, each group configured to play a single note of the musical composition, each of at least two of the groups has a plurality of equally spaced teeth of equal length that collectively play that group's respective note for a duration proportional to the number of teeth in that group by plucking all the teeth of that group consecutively in one continuous stroke, the groups of teeth are separated by gaps wider than the spacing between the teeth of each group, the gaps yielding pauses between adjacent musical notes during play, and the length of the teeth of at least one group differs from the length of the teeth of at least one other group.

5. The personal grooming device of claim 4, wherein:

the lengths of the teeth correspond to relative frequencies of the respective musical notes.

6. The personal grooming device of claim 5, wherein:

the lengths of the teeth of at least two groups differ in accordance with a varied contour of a body surface from which the teeth extend.

7. The personal grooming device of claim 5, wherein:

the length of the teeth of each successively adjacent group of teeth is based on a frequency corresponding to the length of the teeth of a respective preceding group of teeth.

8. The personal grooming device of claim 5, wherein:

the lengths of the teeth correspond to a contour of a body surface from which the teeth extend.

9. The personal grooming device of claim 8, wherein:

the grasping portion includes an outer surface of the body, and the body surface from which the teeth extend is an inner surface opposite the outer surface of the body.

10. The personal grooming device of claim 9, wherein:

the contour of the inner surface of the body is varied.

11. The personal grooming device of claim 4, wherein:

the lengths of the teeth of at least two groups differ in accordance with a varied contour of a body surface from which the teeth extend.

12. The personal grooming device of claim 4, wherein:

the body is expansible.

13. A musical comb usable to comb hair or play notes of a musical composition, comprising:

a graspable body including a base having a varied contour including at least one peak adjacent to at least one valley; and a straight-line arrangement of spaced teeth extending from the base to terminal portions that are collinear, wherein:

the teeth are arranged in at least two groups: a first group of teeth extending from a peak and a second group of teeth extending from a valley, the first group has a plurality of equally spaced first teeth of equal length that collectively play the first group's note for a duration proportional to the number of first teeth by plucking all the first teeth consecutively in one continuous stroke, and the second group has a plurality of equally spaced second teeth of equal length that collectively play the second group's note for a duration proportional to the number of second teeth by plucking all the second teeth consecutively in one continuous stroke.

14. The musical comb of claim 13, wherein:

the first group of teeth and the second group of teeth are separated by a gap wider than the spacing between the teeth of each group.

15. The musical comb of claim 13, wherein:

the lengths of the teeth correspond to relative frequencies of the respective musical notes.

* * * * *